US005953987A

United States Patent [19]

Oleson

[11] Patent Number: 5,953,987

[45] Date of Patent: Sep. 21, 1999

[54] SCREEN PRINTING REGISTRATION SYSTEM

[75] Inventor: Andrew L. Oleson, Carol Stream, Ill.

[73] Assignee: M&R Printing Equipment, Inc., Glen Ellyn, Ill.

[21] Appl. No.: 08/732,518

[22] Filed: Oct. 15, 1996

[51] Int. Cl.[6] ..... B05C 17/06

[52] U.S. Cl. ..... 101/127.1; 101/126; 101/DIG. 36

[58] Field of Search ..... 101/114, 126, 101/127, 127.1, 128.4, 129, 401.1, 485, 486, DIG. 36; 33/614, 615, 616, 619, 620

[56] References Cited

U.S. PATENT DOCUMENTS

| | | | |
|---|---|---|---|
| 2,418,754 | 4/1947 | Brunet | 33/615 |
| 5,168,805 | 12/1992 | Kasanami et al. | 101/128.21 |
| 5,377,422 | 1/1995 | Newman . | |
| 5,503,068 | 4/1996 | Newman . | |
| 5,517,912 | 5/1996 | Winter | 101/114 |
| 5,522,148 | 6/1996 | Newman . | |

OTHER PUBLICATIONS

"A Comprehensive Strategy for Increasing Productivity for Newman Roller Frames® At High Screen Tensions," Stretch Devices Inc.

*Primary Examiner*—Ren Yan
*Attorney, Agent, or Firm*—Wallenstein & Wagner, Ltd.

[57] ABSTRACT

An exposure frame (30) and a registration printing pallet (130) are disclosed for registering a printing screen frame (10) holding a screen (12) first to the artwork (4) and next to the pallet (19) supporting the product (T) to be screened.

4 Claims, 6 Drawing Sheets

FIG. 8
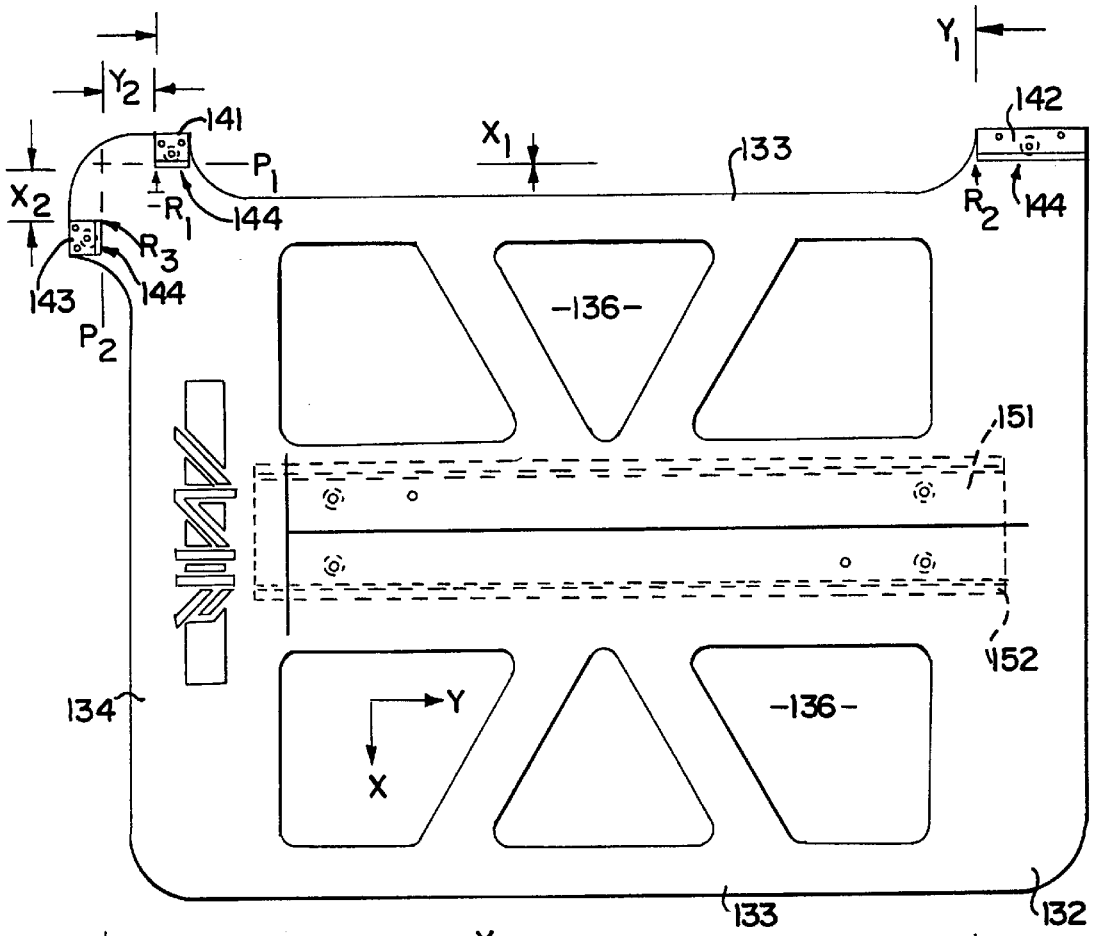
FIG. 9
FIG. 10
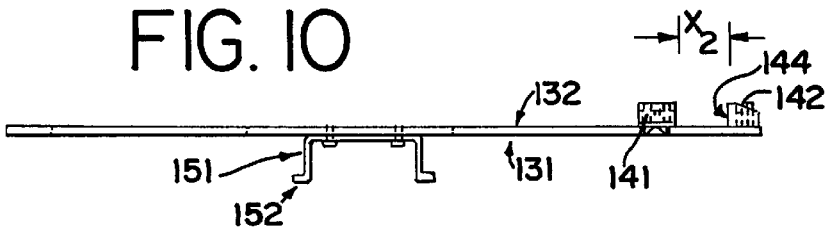

SCREEN PRINTING REGISTRATION SYSTEM

TECHNICAL FIELD

The present invention relates generally to the registration and indexing of artwork to textiles or substrates in a multi-station printing machine and, more particularly, to a novel exposure master frame for registering the artwork to the screen disposed within a screen frame and to a novel printing registration pallet for registering the screen frames to the pallets supporting the items to be screened.

BACKGROUND PRIOR ART

Indicia applied permanently to articles of clothing and other textiles have become very popular. Fanciful indicia, such as logos, slogans, college names, sports team names and sayings, are now commonplace. As a result, screen printing has become very popular. Large, commercial operations screen printing textiles are common today.

Indicia can be one or more colors. Typically, a screen printing machine has at least one station for each color employed. For example, a design incorporating two colors will have at least two printing stations, one for each color. A design employing eight colors will have at least eight stations. Each station generally includes a printing head, which supports a single screen, the ink to be used at that station and a mechanism for applying the ink to the textile. Each color is carried by a single screen. The textile to be screened travels from printing station to printing station by one of a number of methods, such as a chain or a rigid arm. The textile is usually carried by a metal pallet, pallet support, flat bed, or platen. Common printing machines include turret, oval and linear. In addition to printing stations, there may also be curing stations to heat and set the inks placed on the textile or substrate.

Because of the intricacies and the numerous colors involved in more recent designs, registration and indexing of the textiles from station to station have become crucial requiring exacting tolerances. Accordingly, attention is mandatory to these aspects of the screen printing process.

Registration and complete accuracy are further demanded in the process leading up to printing the final product. Immediately following is a brief summary of this process.

First, the artwork is set up. The artwork, in the form of a film positive, is secured on a layout board. This layout board may have outwardly projecting, permanent perimeter pins (or a pin register bar). Next, a carrier sheet (optically clear polyester film) with prepunched perimeter holes is placed on the layout board with the prepunched perimeter holes being aligned with the perimeter pins of the layout board. An individual separates the colors by transferring the artwork by hand to one or more carrier sheets. In this separation/transference process, each carrier sheet represents a separate color to be used in the final screened textile. Thus, if there are six (6) colors being screened, there will be six (6) carrier sheets (Art Separations) completed.

Second, the screens are made. A vacuum exposure unit has basically three elements, that being a light/vacuum source, a cover, and a table disposed therebetween. Each carrier sheet is aligned with a blank screen, the cover is closed, and the screen/carrier sheet combination is subjected to vacuum and light. The result is a printing screen. The screen has interstices in the places where ink of a particular color is to be deposited onto the textile. As noted previously, for each color a different stencilled screen is used.

Third, each printing screen is secured to a printing head. Ink is then placed into the printing heads.

The textiles, one at a time, are loaded onto the travelling pallets and the pallets travel to each of the printing stations. The ink is applied to each textile through the screen at each station. Each textile is cured and the ink permitted to set.

In an effort to continuously improve upon the screening/printing process and machines available in the marketplace, the following advancements and improvements were developed to the apparatus and method of registering printing screens.

SUMMARY OF THE INVENTION

According to a first aspect of the present invention, an apparatus and method are disclosed that include an exposure frame and a printing registration pallet. Both the frame and the pallet include a frame member adapted to cooperate with the printing screen frame holding the screen. This screen frame is used both in the exposure process and the printing process for making a printing. Each frame member has three (3) projections in the form of stop blocks. These projections are used to register the frame members in the exposure and printing processes. The stop blocks are spaced a predetermined distance from one another. And, this predetermined distance can be the same, if desired, for the exposure frame and for the registration pallet. The predetermined distances can also be different. In short, the same three registration points can be used in two separate systems.

The stop blocks cooperate in both uses with the outer edge or perimeter of the screen frame. The blocks each have a substantially planar contact surface facing inwardly of the frame member. With rectangular screen frames, the plane formed by the planar surfaces of the first and second stop blocks is substantially vertical and the plane formed by the planar surface of the third stop block is substantially horizontal. Thus, the angle formed by the intersection of the two planes being approximately ninety degrees.

As to registration, the exposure master frame registers the screen frame to the carrier sheets and the printing registration pallet registers the screen frame and/or printer head to the pallet that carries the textile/substrate.

The exposure frame also includes means for simultaneously urging the printing screen frame against the first, second and third stop blocks. While this can be done manually, there are provided two types of spring blocks attached to the exposure frame to do this. Both types of spring blocks include a bumper housing with an interconnected bumper therein. The bumper projects and is biased outwardly by a spring towards the stop block(s).

The method of using the exposure frame and the printing registration pallet is further disclosed.

Other advantages and aspects of the present invention will become apparent upon reading the following description of the drawings and the detailed description of the invention.

BRIEF DESCRIPTION OF DRAWINGS

To understand the present invention, it will now be described by way of example, with reference to the accompanying drawings in which:

FIG. 8 is a top plan view of the printing registration pallet;

FIG. 9 is a side elevation view of the printing registration pallet;

FIG. 10 is an end elevation view of the printing registration pallet;

DETAILED DESCRIPTION

Figure 1:
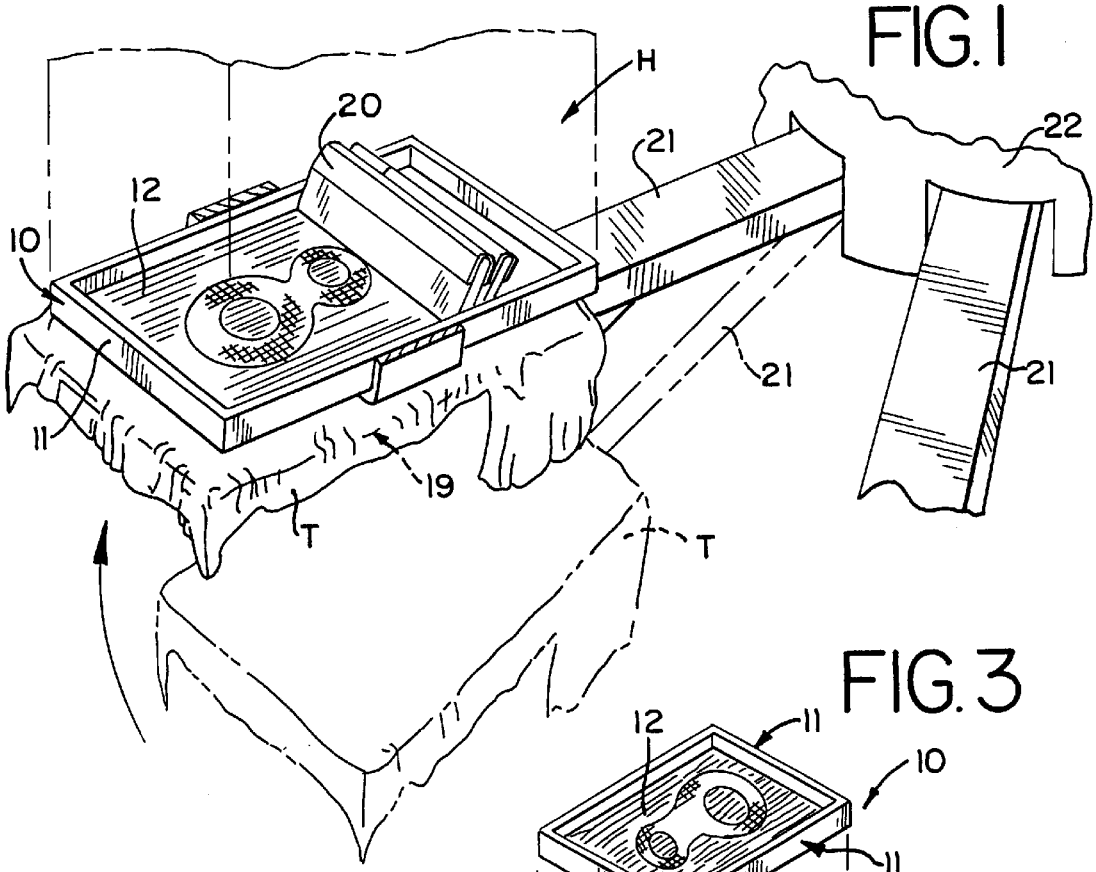
FIG. 1 is a partial perspective view of a single printing station of a printing station.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

The present system is based on the principle of using three (3) points to register/index an article and the transfer of those same three points from one piece of equipment to another piece of equipment. The application of this principle is the use of a similarly composed exposure master frame and a printer registration pallet. Screen frames, each holding a screen to be first prepared and eventually used, are first registered by an exposure master frame. This exposure master frame is in communication with the carrier sheets containing the artwork and the vacuum exposure machine and has a three point registration system thereon. A similarly constructed printer registration pallet with a virtually identical three point registration system thereon is then used as a blank, dummy or indexer in place of the pallet normally used to support the textile/substrate to be printed upon by the printing process. This printer registration pallet is used to register each screen frame and interconnected printer head in the printing assembly. This dummy pallet is moved in the same manner a regular pallet is moved from station to station to register each station.

As a result, the artwork is basically registered to the end, screened product. The same set of three registration points (exposure master frame) used to register the printing screen frame to the carrier sheets may optionally be used in the present system to register the screen frame and printer head (printing registration pallet) to the pallet holding the textile/substrate to be printed upon.

The Exposure Master Frame

The exposure master frame 30 is used in combination with both the carrier sheet 2 and the screen frame 10 on the exposure unit 5 to prepare the printing screen frame and the screen 12.

Figure 2:
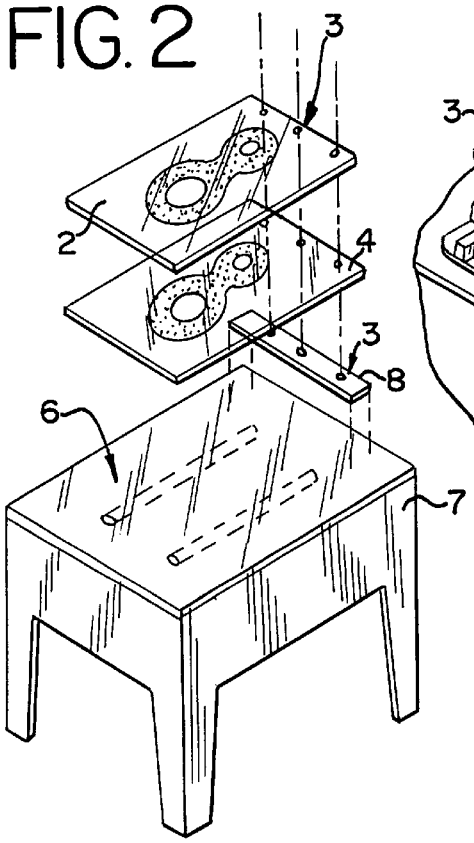
FIG. 2 is an exploded perspective view of the layout board/table.

As noted above, the artwork 4 (positive) to be eventually printed on the textile T is generally secured to a layout board or layout table 7. Commercial layout boards are readily available. Normally, as shown in FIG. 2, a layout board 7 has some registration system, e.g., outwardly projecting, permanent perimeter pins or a pin register bar 8, that cooperates with the carrier sheets 2. By way of example, a carrier sheet 2 of optically clear polyester film may have prepunched perimeter holes 3, here along the top edge, therein to cooperate with the perimeter pins or the pins 9 on a register bar 8 on the layout table 7. The register bar 8 can be fixed to a frame or taped 6 into position. One need only align the pins 9 of the layout board or register bar 8 and the holes 3 in the carrier sheet 2 and secure or clamp the carrier sheet(s) to the layout table/board 7.

By hand or by computer, the images (shown as the number "8" in the Figures) in the artwork 4 on the layout board are transferred to the carrier sheets 2. Each color to be printed is transferred to a separate carrier sheet 2. Accordingly, all images of the artwork to be printed red will appear on one sheet while a separate sheet will contain all images of the artwork to be printed black. This separation and transferring to the individual carrier sheets is continued until all the colors are identified and all the carrier sheets are completed.

Figure 3:
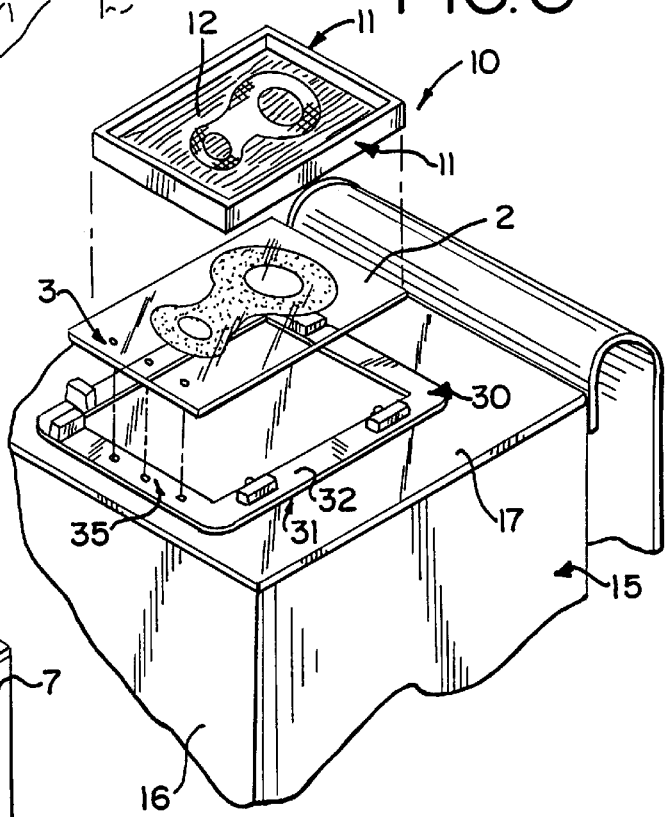
FIG. 3 is a is an exploded perspective view of the exposure unit and the exposure frame of the present invention.

The next process is shown schematically in FIG. 3. Specifically, a vacuum exposure unit 15 is employed. This unit, standard in the screen printing industry, includes a housing 16, containing a light source and a vacuum to draw air into the system, a work surface 17 which permits the light to pass therethrough, and a cover 18. The cover 17 is oftentimes flexible. The work surface 17 is commonly made of glass. The exposure frame 30, having a planar, flat rear surface 31 and front surface 32, is placed on top of or secured to the work surface 17. Tape is often employed to ensure no movement of the exposure frame.

The exposure frame 30 has opposed side members 33 and opposed end members 34. A plurality of perimeter pins 35 (shown in phantom lines in FIG. 5) projecting outwardly from the front surface 32 are spaced apart along the edge of one of the end members 34. A carrier sheet 2 can thus be placed on or in the exposure frame by aligning the preformed holes 3 therein with the perimeter pins 35. The frame 30 is thus disposed between the carrier sheet 2 and the work surface 17.

A portable screen frame 10, with a screen 12 to be exposed secured within the screen frame, is placed on top of the exposure master frame 30. The cover 18 is placed over the work surface 17 and the combination of the exposure master frame 30, the carrier sheet 2 and the screen frame 10. The unit 15 is turned on causing the light source (not shown) to shine upon and the vacuum (not shown) to retain the combination on the work surface 17. By conventional methods well-known in the art, an image (negative) is formed on the screen 12 after exposure and a wash. This procedure of preparing the screens in the screen frames is performed for each color to be used and for each carrier sheet previously prepared. As before, if there are to be six (6) colors on the final product, there will be six carrier sheets and six screens prepared.

When the textile is to be printed, each screen frame and secured stencilled screen embodying the indicia is secured to the printing head H. Either the pallet 19 supporting the textile or substrate T or the printing head H supporting the screen frame 10 is moved into contact with the other so that the screen frame is in communication with the textile/substrate. In the printing head H, one color of ink is flooded onto the screen 12 and squeegeed over the screen by a squeegee 20. This ink passes through the voids (stencil) in the screen causing an image to form on the textile or substrate T. The ink is of the type well-known in the industry.

While perimeter pins 35 are shown on the master exposure frame 30, other forms of alignment may be employed. Different manufacturers of carrier sheets employ different aligning techniques. Each can be optionally incorporated into the exposure frame. For example, as with the layout table and/or board, the work surface may have a separate frame secured thereon having perimeter pins or a register bar with pins. The prepunched perimeter holes in the carrier sheets thus cooperate and mate with the pins on a frame or register bar. One need only align the pins 35 of the frame 30 or register bar and the holes 3 of the carrier sheet 2 to the frame or register bar.

The portable screen frames 10 are conventional in the industry. They typically include a four-sided frame with an internal channel for threading and holding the screen and a tightening mechanism for ensuring the screen is properly stretched within the frame. The screen frames are rigid, not flexible, and can be wood or metal and can be rectangular or tubular in cross-section. Common sizes of frames are 23"×31", 23"×33", 25"×33", and 25"×35". The master exposure frame of the present invention can be used with most known commercial printing screen frames. An example of frames is shown in U.S. Pat. Nos. 5,377,422 and 5,52,148, both titled Roller Frame Alignment Bracket, invented by Donald E. Newman and assigned to Stretch Devices, Inc., Philadelphia, Pa. These disclosures are incorporated herein by reference.

The exposure master frame 30 incorporates a three (3) point R1,R2,R3 registration system. Specifically, three points R1,R2,R3 rigidly connected to the support structure ensure the screen frames 10 and screens 12 are consistently aligned with the carrier sheets 2 on the vacuum exposure unit 15.

Turning to the exposure master frame, it includes two opposed side members 33 and two opposed end members 34. An opening 36 is disposed between the side 33 and end members 34. It is this opening 36 that permits the light to pass through the work surface 17 and onto the screen 12 in the screen frame. There are three (3) rigidly connected projections attached to the exposure master frame. Each projection takes the form in the present embodiment as a stop block 41,42,43.

Figure 5:
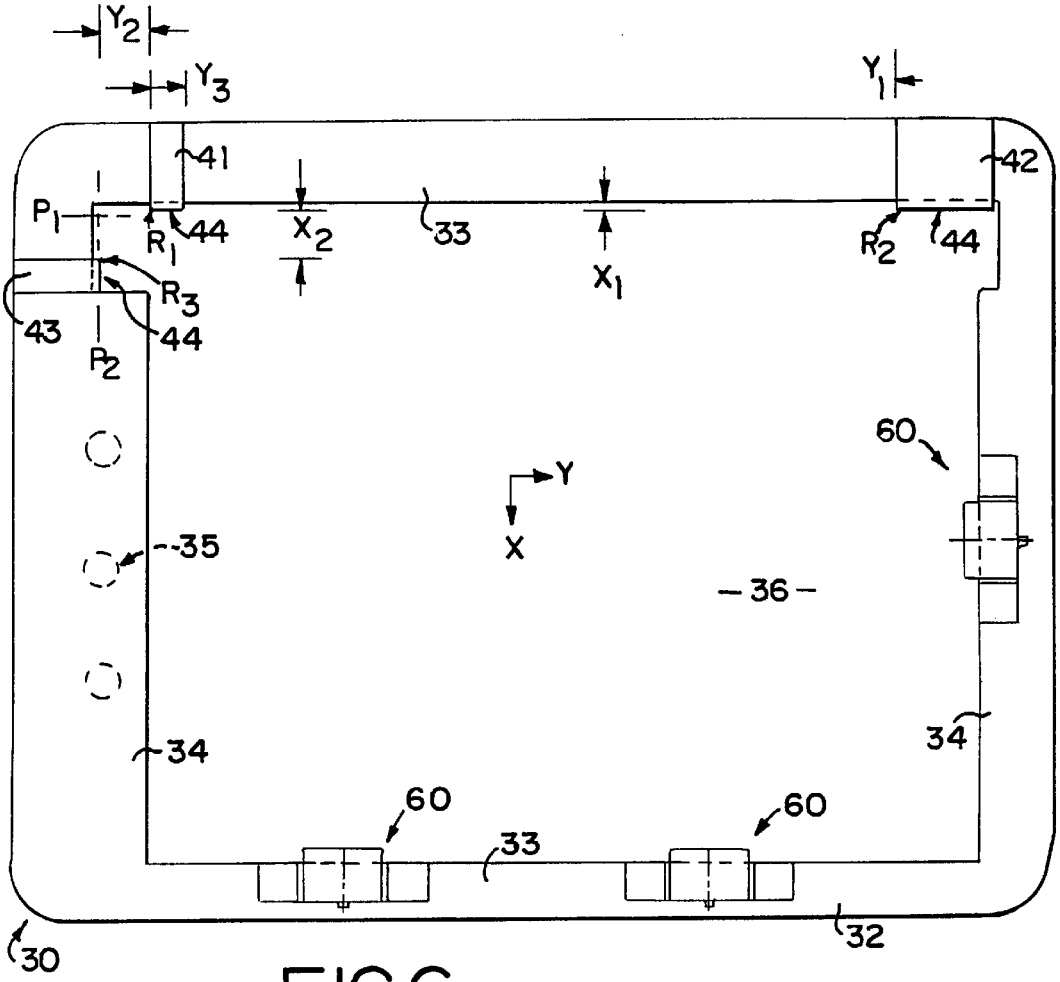
FIG. 5 is a top plan view of the exposure frame.
Figure 6:
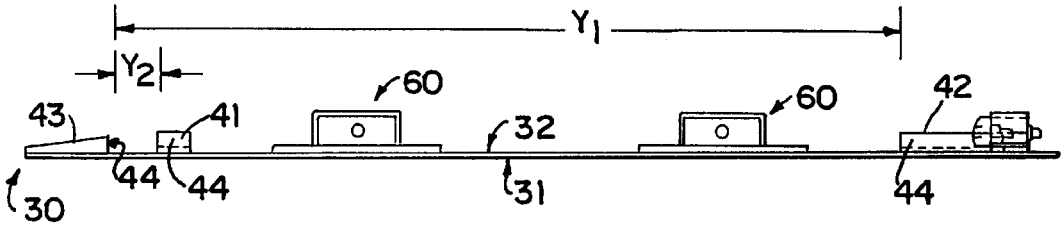
FIG. 6 is a side elevation view of the exposure frame.
Figure 7:
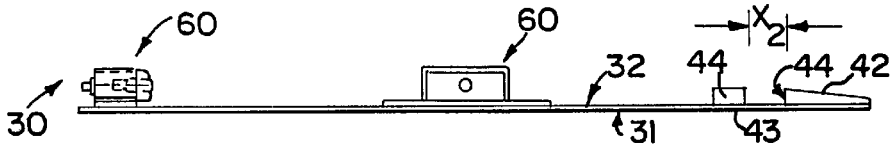
FIG. 7 is an end elevation view of the exposure master frame.

As shown in FIGS. 5–7, a first stop block 41 is positioned on one side member 33 adjacent a corner. A second stop block 42 is positioned on the same side member spaced apart from the first stop block 41. In the present system, these two stop blocks 41,42 are situated along the "long" side 33 of the frame (on the side members). They can, of course, be situated along the "short" side 34 of the frame (on the end members). Having the stops along the long side reduces the possibility of "tail whip," a situation occurring when the carrier sheet's tail moves relative to the screen frame when the vacuum of the exposure unit is turned on.

A third stop block 43 is positioned along one end member 34, spaced from the first stop block 41 and adjacent the same corner.

Using the three (3) reference points indicated as R1 (located on the first stop block 41), R2 (located on the second stop block 42), and R3 (located on the third stop block 43), it can be seen that the second reference point R2 is spaced a predetermined first horizontal distance (X1) and a predetermined first vertical distance (Y1) from the first reference point R1. Similarly, the third reference point R3 is spaced a predetermined second horizontal distance (X2) and a predetermined second vertical distance (Y2) from the first reference point R1. As the screen frame's outer perimeter surface or edge 11 is substantially rectangular, the predetermined first horizontal distance X1 is zero. In the embodiment shown for rectangular screen frames 23"×31" and 23"×33", the distances are:

| | |
|---|---|
| X1 = 0" | Y1 = 26.25" |
| X2 = 1.63" | Y2 = 1.75" |

For rectangular screen frames 25"×33", and 25"×35", the distances are:

| | |
|---|---|
| X1 = 0" | Y1 = 26.25" |
| X2 = 4.63" | Y2 = 1.75" |

And, for rectangular screen frames 23"×31", the distances are:

| | |
|---|---|
| X1 = 0" | Y1 = 26.25" |
| X2 = 4.63" | Y2 = 1.75" |

Each of the stop blocks 41,42,43 is secured to the side or end frame members 33,34 and projects outwardly from the front surface 32 of the frame 30. Each stop block 41,42,43 acts as a stop or bumper and communicates with the outer perimeter or outer edge 11 of the screen frame 10. Each stop block 41,42,43 has a substantially planar, contact surface 44 facing the opening 36 in the exposure frame member 30. The planar contact surfaces 44 of the stop blocks 41,42,43 are substantially vertical. The contact surfaces 44 of the first and second stop blocks 41,42 face in the direction of the third stop block 43 and the opening 36 and the planar, contact surface 44 of the third stop block 43 faces in the direction of the first and second stop blocks 41,42 and the opening 36.

Consequently, when the flat (or even rounded) outer perimeter surface or edge 11 of the screen frame 10 is urged against and abuts the contact surfaces 44 of all three stop blocks 41,42,43, the screen frame, and hence screen, is in registration.

To register the screen frame, one must simultaneously urge the screen frame into simultaneous contact with the three stop blocks. While this can be done manually, there is further provided two types of spring blocks 60,70. The purpose of the spring block 60 is to bias or force the screen frame 10 into the three stop blocks 41,42,43. Both types of spring blocks 60,70 include a bumper housing 61,71 connected (shown as welded) to the master exposure frame 30, a bumper 62,72 projecting and biased outwardly towards the opening or one of the stop blocks, an internal biasing spring 63,73 and a means for interconnecting the bumper to the housing 64,74.

Figure 11:
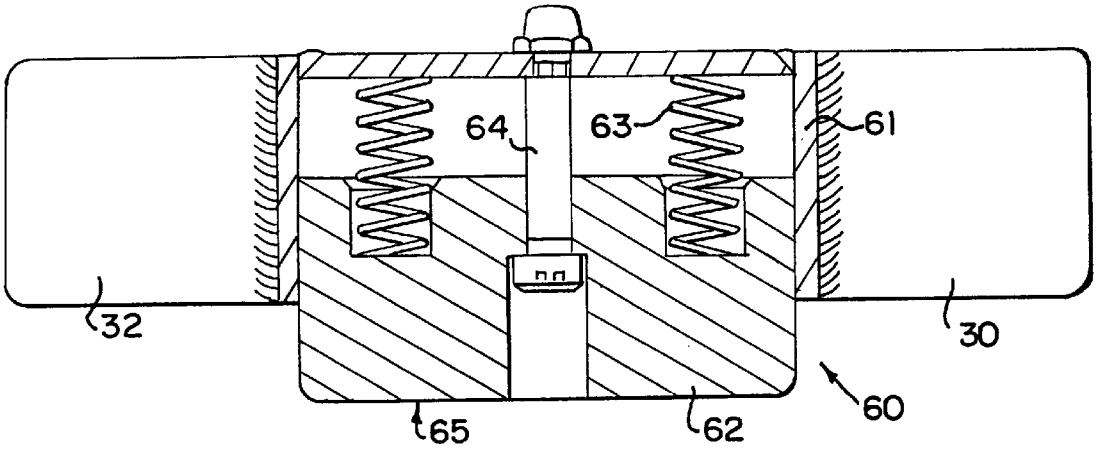
FIG. 11 is a sectional view of a first spring block along line 11—11 in FIG. 12.
Figure 12:
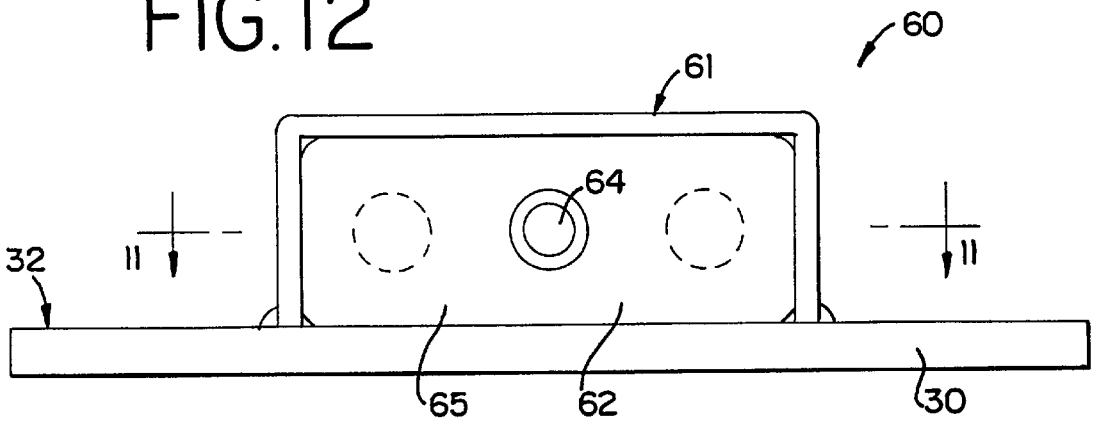
FIG. 12 is a side elevation view of the first spring block.
Figure 13:
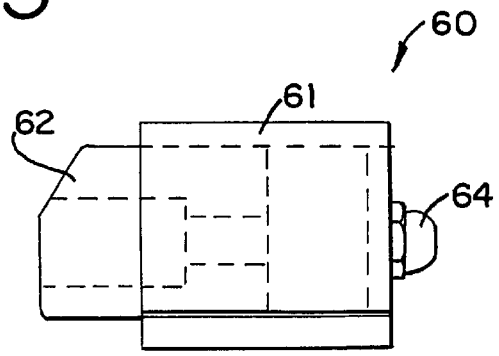
FIG. 13 is an end elevation view of the first spring block.

As shown in FIGS. 11–13, the first type of stop block 60 includes a rectangular housing 61. This housing 61 is welded to the side or end member. A rectangular bumper 62 is nestled in the housing 61. A central channel holds a fastener 64, with a head thereon, secured to the housing 61. The other two channels hold springs 63. The springs 63 push the bumper 62 outside the housing 61, while the fastener 64 keeps the bumper interconnected to the housing. The head 65 of the fastener acts as a stop.

Figure 14:
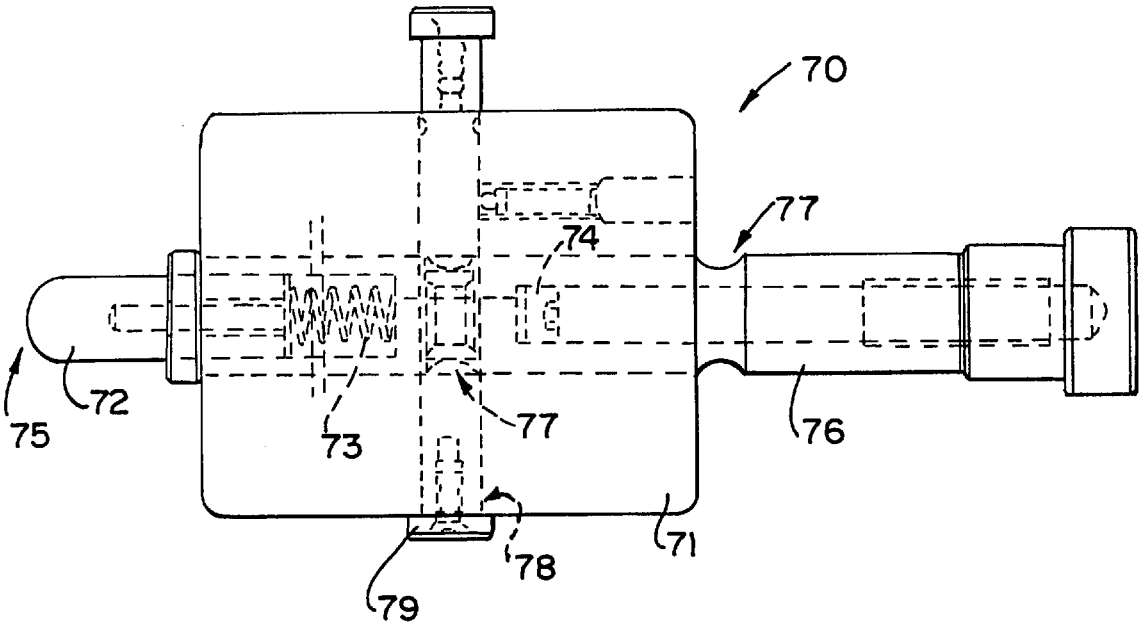
FIG. 14 is a top plan view of a second spring block.
Figure 15:
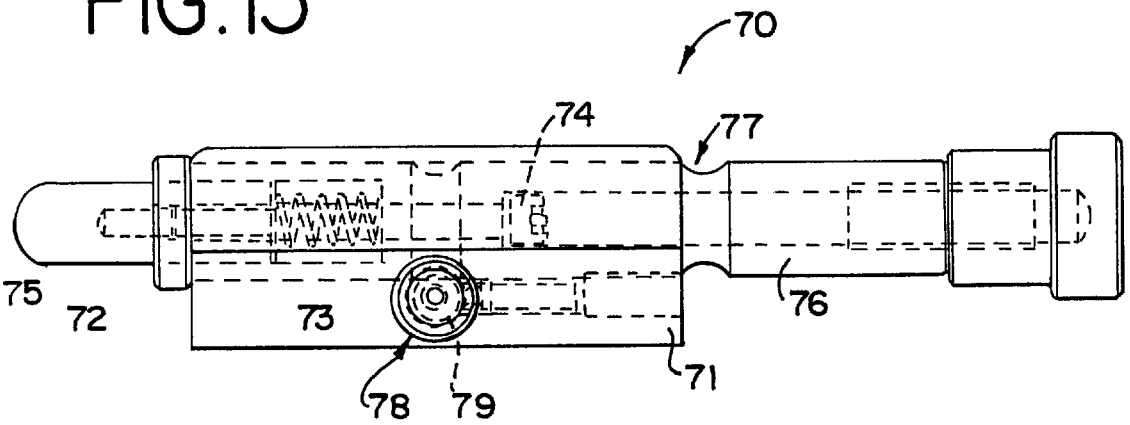
FIG. 15 is a side elevation view of the second spring block.
Figure 16:
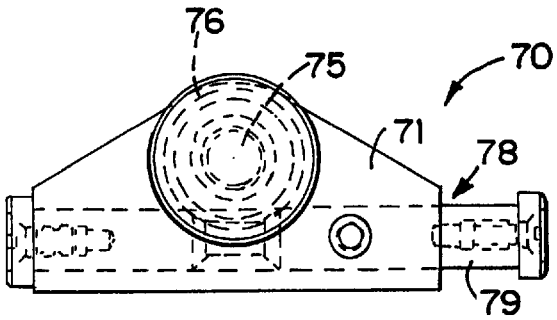
FIG. 16 is an end elevation view of the second spring block.

As shown in FIGS. 14–16, the second type of stop block 70 permits greater adjustability. A bumper 72 is secured to a cylindrical rod 76 with annular notches 77 therein. As with the first spring block, this second spring block 70 includes a housing 71 secured to an end member or side member, and a bumper 72 biased by an internal spring 73. An internal fastener 74 within the rod 76 prevents the bumper cap 72 from separating from the rod. As noted, the rod 76 has two or more annular notches 77. These notches 77 can be aligned with a locking pin hole 78 in the housing 71; a locking pin 79 is next inserted. The locking pin 79 passes through the housing 71 and into the notches 77 to secure the rod 76 into position. As a result, the bumper can be selectively locked into different positions to contact (tip 75) and urge screen frames of different sizes. The more spring blocks of this second type employed, the more options, flexibility one has with screen frames of different sizes.

The Printer Registration Pallet

Once the screens 12 within the screen frames 10 are prepared, they are ready to be used in the screen printing machine. As mentioned, the colors are separated. A screen is prepared for each color to be used in the final product.

When the textile T is to be printed, each screen frame 10 and secured screen 12 is secured to a printing head H. Printing machines available on the market are diverse. Generally, there is one printing station per color or prepared screen. Typically, a pallet 19 supporting the textile or substrate T to be printed upon travels from one print station to another. Once at the printing station, the textile T is brought into communication with the printing screen 12 and printing screen frame 10. Either the pallet 19 supporting the textile/substrate T or the printing head H supporting the screen frame 10 is moved into contact with the other so that the screen frame 10 is in communication with the textile/substrate T. In some machines, the pallet is raised to the printing head and in other machines, the printing head is lowered to the pallet. The present invention is suitable for either technique. In the printing head H, ink is squeegeed 20 over the screen 12 and transferred to the textile/substrate T through the voids in the screen 12. The result is the formation of an image on the textile or substrate T.

In the Figures, a printing head, designated by the reference number H, is stationary and the pallet is raised to it. Specifically, the printing machine incorporates a plurality of printing stations and a plurality of pallets that travel. The pallets 19 are supported on the distal end of a radial pallet arm 21. The other end of the radial arm 21 is connected to a rotating turret 22. The turret 22 rotates the pallets 19, from one station to the next, stopping long enough to index each pallet at a station and then print at the station. A highly successful machine of this nature, and incorporated herein by reference, is disclosed in U.S. Pat. No. 5,129,155, titled AUTOMATIC SCREEN REGISTRATION DEVICE AND METHOD THEREFOR, and is assigned to the Assignee of the present invention, M & R PRINTING EQUIPMENT, INC., Glen Ellyn, Ill.

Indexing of the pallet is the process of aligning the pallet at the station so that each pallet that passes therethrough is aligned exactly as the preceding pallet passing therethrough. Registration of the pallet is the process of aligning the pallet, once properly indexed, with the screen frame and screen. The indexing of pallets on an oval type machine are disclosed and claimed in U.S. Pat. Nos. 4,735,139 and 4,909,146.

In the past, registration of the printing screens relative to the pallet supporting the textile was often performed by trial and error. The present invention eliminates this trial and error.

A dummy or printing registration pallet 130, shown in FIGS. 1, 4 and 8–10, is used in place of a regular pallet 19 to register all the printing screens. This dummy pallet 130 is placed on the machine 21,22 in lieu of a regular pallet 19 and moved, one at a time, through each of the stations H. While at the station, the registration pallet 130 aligns and registers the printing screen frame 10 supporting the printing screen 12. The screen frame 10 is locked into position and ready for actual use with the textiles to be printed upon.

Figure 4:
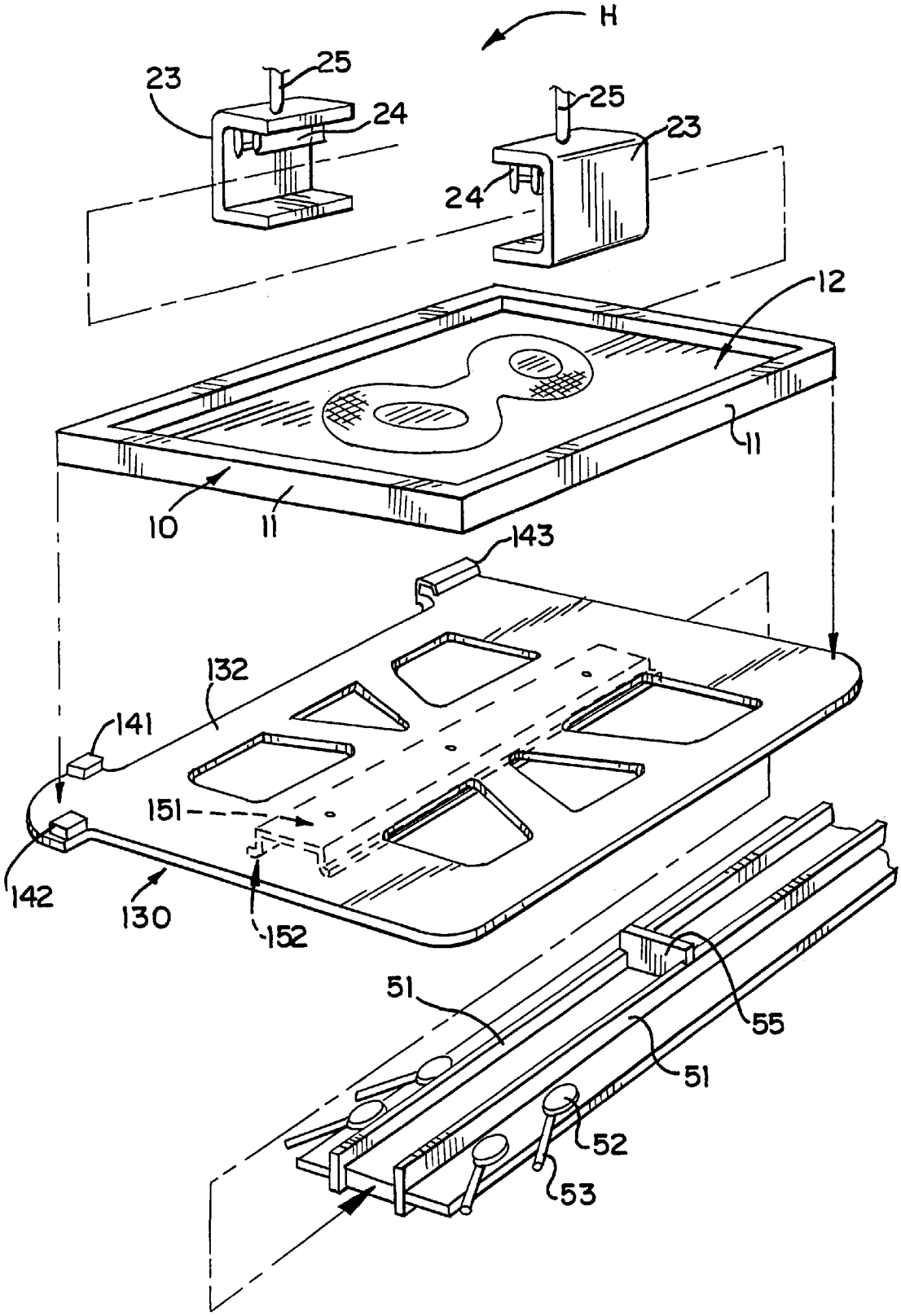
FIG. 4 is a is an exploded perspective view of a printing station and the printing registration pallet of the present invention.

In FIGS. 1 and 4, the printing head H is schematically shown. This printing head H supports the screen frame 10 and is either directly adjustable or the screen frame is adjustable relative to the printing head H. An example of an adjustable screen relative to the printing head is disclosed in U.S. Pat. Nos. 4,939,991 and 5,129,155, incorporated herein by reference. In this reference, the thumbscrews are used to adjust and clamp the screen into position. In the embodiment shown, the screen frame 10 is supported within two flanges 23 and is adjustable relative to the printing head H. A clamp bar 24 with thumb screws 25 is schematically shown in FIG. 4. The frame 10 is movable relative to the two flanges 23 and can be locked into a desired position by the clamp bar 24 and thumb screws 25. By adjustable, one means that the screen frame (or printer head) can be moved (radially and tangentially or horizontally and vertically) relative to the pallet supporting the textile. Adjustment techniques are many and conventional in the industry.

The printing registration pallet 130 has a printer frame member which has a front surface 132 and a rear surface 131. The frame 130 further includes two side members 133 and two integral end members 134. A plurality of holes 136 are in the frame and one side edge 133 has been trimmed to reduce the weight of the frame 130.

As with the exposure master frame 30, a first projection R1 in the form of a stop block 141 projects outwardly from the front surface 132 of the pallet frame 130. This stop block 141 is similarly rigidly connected to the frame, either one of the side members 133 or one of the end members 134. A second projection R2, also a stop block 142, projects outwardly from the front surface and is rigidly connected to one side member 133. This second stop block 142 is spaced apart from and positioned a first predetermined horizontal distance and a first predetermined vertical distance from the first stop block 141. Again, as with the exposure master frame 30, a third projection R3 (the third stop block 143) projects outwardly from the front surface 132 of the frame 130 and is rigidly connected to an end member 134. This third stop block 143 is spaced apart from and positioned a second predetermined horizontal distance and a second predetermined vertical distance from the first stop block 141.

On the rear surface 131 of the printer frame 130, there is provided a means for cooperating with the means for retaining the pallet. Turning to FIG. 4, the distal end of the pallet arm 21 has two tracks 51 with two opposed flanges 52 extending outwardly. Each flange 52 supports one or more eccentric cams 53. The eccentric cams 53 are controlled by knobs 54. The registration pallet (and a standard pallet) has a depending channel member 151 with the outward flanges 152 that cooperate (rest upon) with the track 51 on the radial arm 21. The pallet 19,130 is aligned so the channel member 151 can be slid onto the track 51 until it hits a stop 55 on the arm 21. Once the pallet 19,130 abuts the stop 55, the knobs 53 are turned until the eccentric cams 52 frictionally engage and lock flanges 152 of the channel member 151 into position. The registration pallet 130 is thus locked onto the arm 21.

To remove the registration pallet, the eccentric cams 52 are turned and their grip on the channel member 151 and flanges 152 are loosened. The registration pallet 130 is then slid off the arm 21. Once the registration pallet is off the arm, a standard pallet supporting a textile/substrate can be slid and locked onto the arm.

Once the registration pallet 130 is locked onto the arm 21, the registration pallet can be moved to the first printing station. The printing screen and the registration pallet are next brought into contact with one another. And, the outer frame perimeter or edge 11 of the screen frame 10 is brought into contact with the three stop blocks 141,142,143. The screen frame 20 is thus registered locked into position on the printing head H.

Turning back to the stop blocks, the first and third stop blocks 141,143 are positioned adjacent a corner. The second stop block 142 is positioned on the "long" side spaced from the first stop block 141.

Using the three (3) points indicated as R1 (located on the first stop block 141), R2 (located on the second stop block 142), and R3 (located on the third stop block 143), it can be seen that the second reference point R2 is spaced a predetermined first horizontal distance (X1) and a predetermined first vertical distance (Y1) from the first reference point R1. Similarly, the third reference point R3 is spaced a predetermined second horizontal distance (X2) and a predetermined second vertical distance (Y2) from the first reference point R1. As the screen frame 10 (outer perimeter surface and outer edge 11) is substantially rectangular, the predetermined first horizontal distance X1is zero. As readily recognizable, the angle formed by the intersection of the two lines (Line R1R2 and Line R1R3) are approximately ninety degrees. The plane P1 formed by the planar surfaces of the first and second stop blocks 41,42 is substantially vertical and the plane P2 formed by the planar surface of the third stop block 43 is substantially horizontal. The angle formed by the intersection of these two planes P1,P2 is approximately ninety degrees. In the embodiment shown for rectangular screen frames, the distances are:

| | |
|---|---|
| X1 = 0" | Y1 = 26.25" |
| X2 = 1.63" | Y2 = 1.75" |

Each stop block 141,142,143 has a substantially planar, contact surface 144 that is substantially vertical and faces inwardly of the printer frame member. In short, the planar surfaces 144 of the first and second stop blocks 141,142 face in the direction of the third stop block 143 and the planar surface 144 of the third stop block 143 faces in the direction of the first and second stop blocks. When a substantially rectangular printing screen frame is employed, the plane P1 formed by the planar surfaces of the first and second stop blocks 141,142 is substantially vertical and the plane P2 formed by the planar surface of the third stop block 143 is substantially horizontal. The angle formed by the intersection of these two planes P1,P2 is approximately ninety degrees.

Once the first screen frame at the first printing station has been registered, the registration pallet is moved out of communication with the screen frame and moved to the next printing station, printing head and second screen frame. The registration pallet is moved through every printing station and used to register every screen frame. When this is completed, all the screen frames are registered and the machine is ready for regular, normal operation. The standard pallets for supporting textiles and substrates are locked onto the arms of the machine and the machine is prepared to be turned on and fully operational.

While the specific embodiments have been illustrated and described, numerous modifications are possible without significantly departing from the spirit of the invention and the scope of protection is only limited by the scope of the accompanying Claims.

We claim:

1. A printing registration pallet for use with at least two printing stations, each station having (1) means for retaining a pallet supporting a textile or substrate to be printed upon and (2) a printing head supporting a screen frame and having adjustment means to adjust either the printing head or the screen frame relative to the registration pallet when the registration pallet is in communication with the screen frame, the screen frame including an outer frame perimeter and holding a screen, said printing registration pallet consisting essentially of:

a printer frame member having a first surface and a second surface, two side members and two integral end members;

a first projection projecting outwardly from and rigidly connected to the printer frame member on the first surface, the first projection having substantially planar, stationary contact surface for directly contacting the screen frame;

a second projection projecting outwardly from and rigidly connected to the printer frame member on the first surface, the second projection having a substantially planar, stationary contact surface for directly contacting the screen frame and being spaced apart from and positioned a first predetermined horizontal distance and a first predetermined vertical distance from the first projection;

a third projection projecting outwardly from and rigidly connected to the printer frame member on the first surface, the third projection having a substantially planar, stationary contact surface for directly contacting the screen frame and being spaced apart from and positioned a second predetermined horizontal distance and a second predetermined vertical distance from the first projection; and, means connected to the second surface of the printer frame member for cooperating with each of the means for retaining a pallet to both retain and remove the printer frame member for registering the screen frame, the first, second and third projections forming a right angle and cooperating with the outer frame perimeter of the printing screen at each printing station to register the printing screen frame relative to the printer frame member when the registration pallet is in communication with the screen frame.

2. The printing registration pallet of claim 1 wherein the printer frame member is generally rectangular.

3. The printing registration pallet of claim 2 wherein the planar surfaces of the first, second and third projections are substantially vertical and the planar surfaces of the first and second projections face in the direction of the third projection and the planar surface of the third projection faces in the direction of the first and second projections.

4. The printing registration pallet of claim 3 wherein the printing screen frame is substantially rectangular having two opposed sides and two opposed ends and the plane formed by the planar surfaces of the first and second projections is substantially vertical and the plane formed by the planar surface of the third projection is substantially horizontal, the angle formed by the intersection of the two planes being approximately ninety degrees.

* * * * *

UNITED STATES PATENT AND TRADEMARK OFFICE

CERTIFICATE OF CORRECTION

PATENT NO. : 5,953,987
DATED : September 21, 1999
INVENTOR(S) : Andrew L. Oleson It is certified that error appears in the above-identified patent and that said Letters Patent is hereby corrected as shown below:

Column 11,
Line 2, delete "registration" and insert therefor -- frame --
Line 9, after "having" and before "substantially" insert -- a --

Signed and Sealed this

Thirty-first Day of July, 2001

*Attest:*

Nicholas P. Godici

NICHOLAS P. GODICI
*Acting Director of the United States Patent and Trademark Office*

*Attesting Officer*